United States Patent [19]

Ohno et al.

[11] Patent Number: 4,807,263

[45] Date of Patent: Feb. 21, 1989

[54] COUNTER OF OBJECTS BEING TRANSPORTED

[75] Inventors: Kinichiro Ohno, Tokyo; Mitsuru Kawabata, Kawasaki, both of Japan

[73] Assignee: Tokyo Kikai Seisakusho, Ltd., Tokyo, Japan

[21] Appl. No.: 32,006

[22] Filed: Mar. 27, 1987

[30] Foreign Application Priority Data

Mar. 27, 1986 [JP] Japan ..... 61-69188

[51] Int. Cl.[4] ..... G06M 7/06

[52] U.S. Cl. ..... 377/8; 377/49

[58] Field of Search ..... 377/8, 49, 6

[56] References Cited

U.S. PATENT DOCUMENTS

| | | | |
|---|---|---|---|
| 3,414,732 | 12/1968 | Stegenga | 377/8 |
| 3,790,759 | 2/1974 | Mohan et al. | 377/8 |
| 4,217,491 | 8/1980 | Dufford et al. | 377/8 |
| 4,296,314 | 10/1981 | Dabisch et al. | 377/8 |
| 4,384,195 | 5/1983 | Nosler | 377/8 |
| 4,450,352 | 5/1984 | Olsson | 377/8 |
| 4,481,667 | 11/1984 | Price et al. | 377/8 |

*Primary Examiner*—John S. Heyman

*Attorney, Agent, or Firm*—McGlew & Tuttle

[57] ABSTRACT

A device for counting objects being transported by transport equipment includes a light projector for projecting a light beam onto the objects being transported, a light receptor for receiving the light beam reflected from the objects being transported and focusing the beam to a point, and a pulse generating means for generating pulses in accordance with the abrupt shift of the focused point of the reflected light beam caused by the ends of the objects being transported.

The objects being transported are counted on the basis of the pulses generated by the pulse generating means.

3 Claims, 5 Drawing Sheets

COUNTER OF OBJECTS BEING TRANSPORTED

BACKGROUND OF THE INVENTION

1. Field of the Invention

This invention relates generally to a counter of objects being transported by transport equipment, and more particularly to a counter of objects being transported in which the quantity of the objects being transported is counted by projecting a light beam onto the objects being transported, which are moving in a feathered state, that is, with the ends or corners thereof disposed continuously at certain intervals, and detecting the sharp changes in the level of the light reflecting point caused by the difference in the height of the objects being transported.

2. Description of the Prior Art

Counters of objects being transported, such as printed matter, which are moved by transport equipment, can be roughly divided into the contact type and the non-contact type which includes the proximity sensor type and the photosensor type.

Among them, the photosensor type, which is capable of counting objects without making contact therewith, is most commonly used.

The photosensor type counters include the light transmission type, the light reflecting type and other various variations, including apparatuses as disclosed in Japanese Patent Publication No. 770 of 1968 or Japanese Patent Publication No. 30334 of 1971.

The apparatus disclosed in Japanese Patent Publication No. 770 of 1968 counts the quantity of objects being transported by projecting a light beam onto the objects, amplifying the output obtained by detecting the reflected light beam within a predetermined range, and generating pulses in accordance with the number of the objects.

Since such counters, which generate pulses based on the detected intensity of the reflected light, require the surface condition, that is, color tone (lightness, saturation and hue) and roughness, of the objects being transported to be kept in a predetermined range, they lack in versatility and cannot ensure good counting performance, particularly in counting objects having different color tones.

The apparatus disclosed in Japanese Patent Publication No. 30334 of 1971 counts the quantity of objects being transported by intercepting a light path from a predetermined light source to a photoelectric transducer by the thickness of the objects.

In this type of apparatus, which intercepts the light path by the thickness of the objects, there is the need for controlling the travelling path of the objects so as to make sure that the objects intercept the fixed light path without fail. If objects being transported are made of a flexible material, controlling the travelling path may retard the flow of the objects, making counting impossible. Furthermore, relatively tight tolerances required for the thickness of the objects tend to limit the applicable types of objects being transported.

SUMMARY OF THE INVENTION

It is an object of this invention to provide a counter of objects being transported capable of counting the objects in the non-contact state and regardless of the surface condition of the objects.

It is another object of this invention to provide a detector which detects sharp changes in the height of the objects which move at constant speed.

It is a further object of this invention to provide a light receptor which is capable of detecting changes in the height of the objects by means of a one-dimensional position sensor.

It is still a further object of this invention to provide a pulse generating circuit which generates pulses for counting the quantity of objects based on the abrupt shift of the focused point of the reflected light received by the light receptor.

The embodiments disclosed herein comprise a light projecting means for projecting a light beam onto objects being transported by transport equipment, a light receiving means for receiving the light beam and focusing the beam on a light receiving surface comprising position sensor elements, and a pulse generating means for generating pulses in accordance with the abrupt shift of the focus point of the reflected light caused as the light beam projected by the light projecting means impinges on the end of an object being transported, and are adapted so that the objects being transported are counted by the pulses generated by the pulse generating means.

DETAILED DESCRIPTION OF PREFERRED EMBODIMENTS

In the following, embodiments of this invention will be described in detail, referring to the accompanying drawings, in an application where the number of folded copies of printed matter, which are transported in a feathered fashion, are counted.

Figure 1:
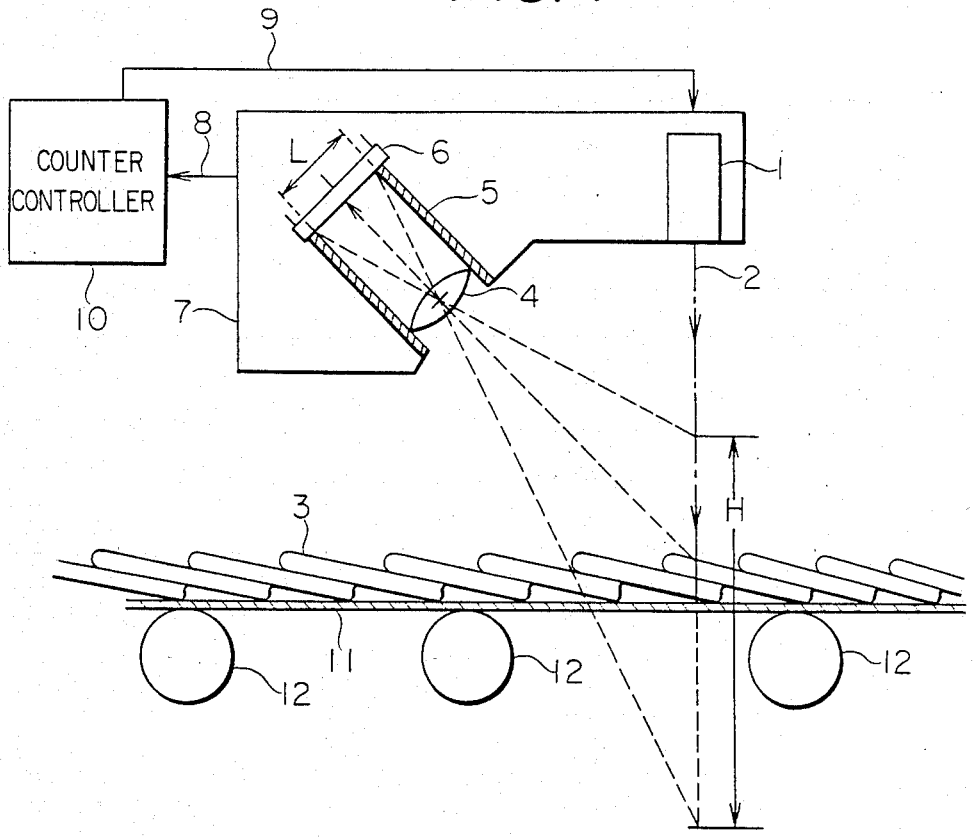
FIG. 1 is a diagram illustrating the general construction of an embodiment of this invention.

First, the outlined construction of an embodiment of this invention will be described, referring to FIG. 1. In FIG. 1, numeral 1 refers to a laser beam projector; 2 to a laser beam; 3 to a printed copy as an object being transported; 4 to a lens; 5 to a holder; 6 to a one-dimensional position sensor; 7 to a chassis; 8 to a signal line; 9 to a power line; 10 to a counter controller; 11 to a conveyor belt; and 12 to a conveyor roller, respectively.

The lens 4 and the one-dimensional position sensor 6 are held by the cylindrical holder 5, and the chassis 7 holds the laser beam projector 1 and the holder 5 in such a manner as to cover the entire assembly. These components comprise a counter. The light is projected onto the one-dimensional position sensor 6 only through the lens 4. As shown in the figure, as the printed copy 3, as an object being transported, is transported at constant speed by a belt conveyor consisting of the conveyor belt 11 and the conveyor roller 12, the laser beam 2 is projected onto the printed copy 3 from the laser beam projector 1 which receives power from the counter controller 10 via the power line 9.

The laser beam 2 which is diffuse-reflected at a reflecting point by the printed copy 3 is collected and focused by the lens 4 to a position corresponding to the level of the laser beam reflecting point on the light receiving surface of the one-dimensional position sensor 6. The focused point is shown by a dotted-line arrow in the figure.

The position of the focused point and the amount of light received at the one-dimensional position sensor 6 are converted into electrical signals, and inputted into the electrical circuit of the counter controller 10 via the signal line 8. In the electrical circuit, the inputted electrical signals are converted further into electrical signals corresponding only to the position of the abovementioned focused point.

In this way, changes from time to time in the level of the reflecting point of the laser beam 2 on the surface of the printed copy 3 being transported at constant speed on the belt conveyor are grasped within an H range (the range of the level of the reflecting point corresponding to the length L of the one-dimensional position sensor 6) shown in FIG. 1, and converted into electrical signals corresponding only to the level of the reflecting point (hereinafter referred to as the level signal). The number of the printed copies 3 is counted by detecting the state in which the level of the reflecting point abruptly changes according to the level difference caused by the folds of the printed copies 3 in the form of abrupt changes in the level signal, and the count signals are outputted to the outside of the counter controller 10.

Next, the counting method in the embodiments of this invention will be described in detail, referring to FIGS. 2 through 5.

Figure 2A:
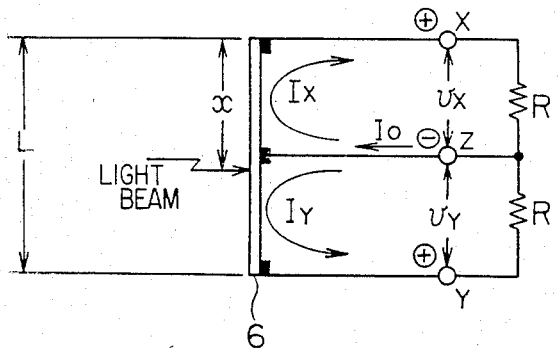
FIG. 2 is a diagram of assistance in explaining a one-dimensional position sensor used in the embodiment shown in FIG. 1.
Figure 2B:
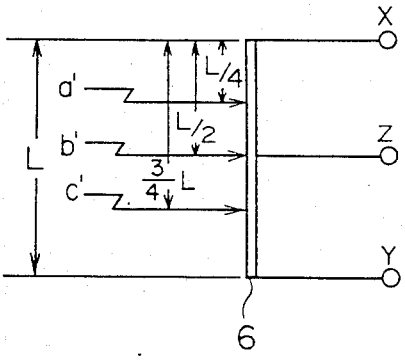

The one-dimensional position sensor 6 shown in FIG. 2 (A) is a one-dimensional position sensor manufactured by Hamamatsu Photonics Co., Ltd., for example. By connecting fixed resistors having the same resistance value R across the terminals of the one-dimensional position sensor 6 and projecting a light beam onto the light receiving surface of the one-dimensional position sensor 6, the one-dimensional position sensor 6 acts as a current source, producing different current loops $I_X$ and $I_Y$ across the terminals thereof, as shown in FIG. 2 (A). Thus, potential differences are caused by the resistances R in polarities shown in the figure.

When a light beam is projected onto the light receiving surface of the one-dimensional position sensor 6, the current loops $I_X$ and $I_Y$ can be expressed by the following equation, using the total photocurrent $I_0$ ($=I_X+I_Y$) that flows in accordance with the amount of received light $$I_X = \frac{x}{L} I_0,\ I_Y = \frac{L-x}{L} I_0 \qquad \text{Eq. (1)}$$

where L is the length of the light receiving surface of the one-dimensional position sensor 6, and x is the distance from the end of the light receiving surface on the X terminal side to the light spot. (The equation above was quoted from a technical document published by Hamamatsu Photonics.)

The terminal voltages $V_X$ and $V_Y$ can be expressed by the following equation, using Eq. (1) above.

$$V_X = I_X R = (x/L)\, I_0 R$$

$$V_Y = I_Y R = ((L-x)/L)\, I_0 R \qquad \text{Eq. (2)}$$

Figure 3:
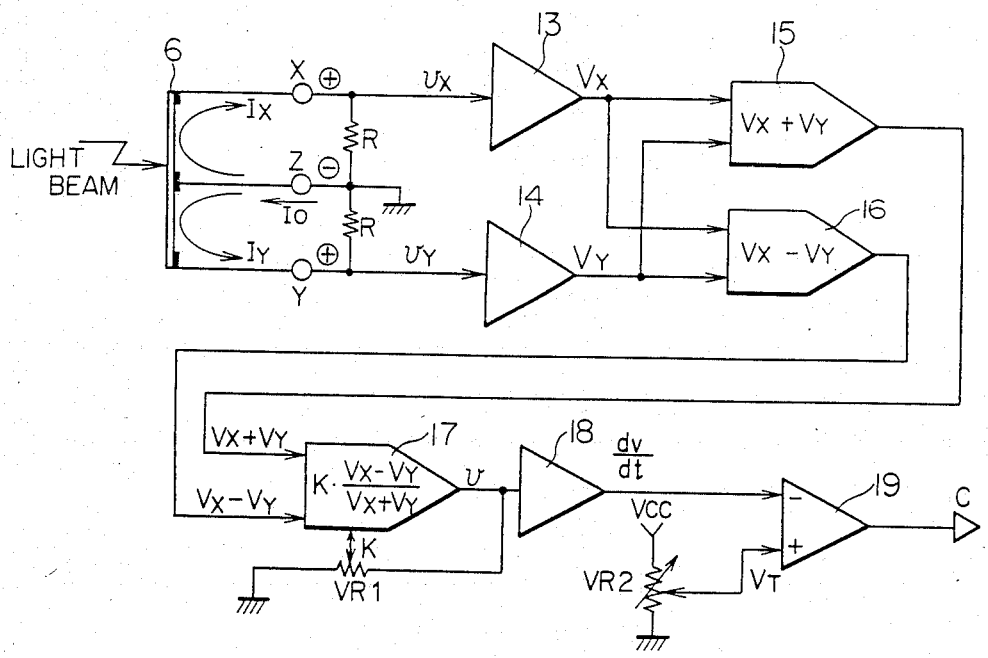
FIG. 3 is a block diagram of an electrical circuit used in the embodiment shown in FIG. 1.

In the electrical circuit shown in FIG. 3, numerals 13 and 14 refer to amplifiers; 15 to an adder; 16 to a subtracter; 17 to a divider; 18 to a differentiating circuit; and 19 to a comparator, respectively.

As shown in FIG. 3, the common terminal Z of the one-dimensional position sensor 6 is grounded to zero volts, with the output voltage signals at the X and Y terminals being inputted to the amplifiers 13 and 14 both having the same voltage amplification degree G. The output voltage signals $V_X$ and $V_Y$ of the amplifiers 13 and 14 can be expressed by the following equation, using Eq. (2) above.

$$V_X = v_X G = \frac{x}{L} I_0 RG \qquad \text{Eq. (3)}$$

$$V_Y = v_Y G = \frac{L-x}{L} I_0 RG$$

The output voltage signal $V_X$ is inputted to the augend input terminal of the adder 15 and to the minuend input terminal of the subtracter 16, while the output voltage signal $V_Y$ is inputted to the addend input terminal of the adder 15 and to the subtrahend input terminal of the subtracter 16.

Furthermore, the output voltage signal $V_X+V_Y$ of the adder 15 is inputted to the divisor input terminal of the divider 17, while the output voltage signal $V_X-V_y$ is to the dividend input terminal of the divider 17. At this time, the output voltage v of the divider 17 can be expressed by the following equation, using Eq. (3) above.

$$v = K\frac{V_X - V_Y}{V_X + V_Y} = K\frac{(x/L)I_0RG - ((L-x)/L)I_0RG}{(x/L)I_0RG + ((L-x)/L)I_0RG} = K\frac{2x-L}{L} \qquad \text{Eq. (4)}$$

(where K is a constant that can be adjusted by means of VR1 shown in the figure.)

As is apparent from Eq. (4), the output voltage v of the divider 17 corresponds only to the level of the reflecting point of the laser beam 2 shown in FIG. 1 on the surface of the printed copy 3.

Figure 4:
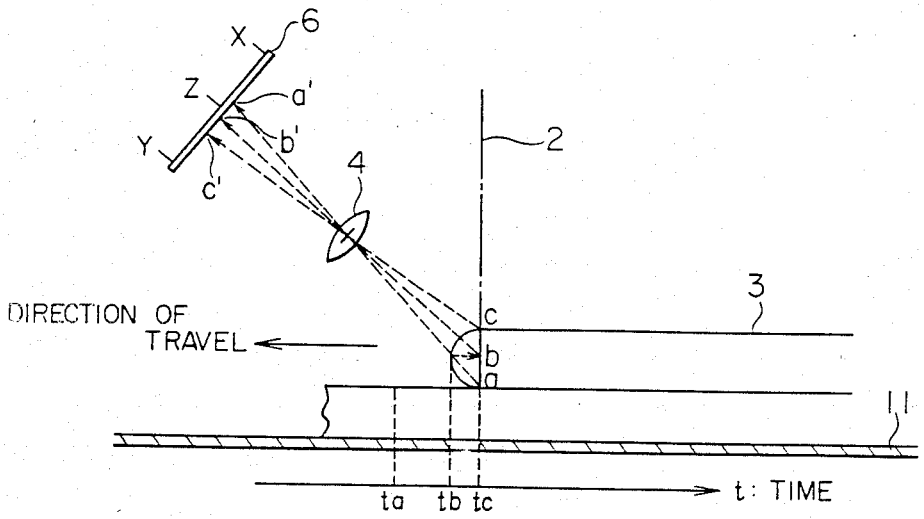
FIGS. 4 and 5 are diagrams of assistance in explaining the basic concept of the embodiment shown in FIG. 1.

As the printed copy 3 moves along in the direction shown by an arrow in the figure with the lapse of time ($t_a$ -- $t_b$--- $t_c$), as shown in FIG. 4, the laser beam reflecting point moves to locations a, b and c at times $t_a$, $t_b$ and $t_c$, respectively, and the focused point on the light receiving surface of the one-dimensional position sensor 6 corresponding to the reflecting point positions a, b and c moves to locations a', b' and c' accordingly. Now, assuming that the focused point positions a', b' and c' are as shown in FIG. 2 (B), the output voltages $v_{ta}$, $v_{tb}$ and $v_{tc}$ of the divider 17 shown in FIG. 3 at times $t_a$, $t_b$ and $t_c$ can be obtained as follows by substituting x=(L/4), x=(L/2) and x=(3L/4) into Eq. 4.

$$v_{ta} = -K/2,\ v_{tb} = 0,\ v_{tc} = K/2$$

Figure 5A:
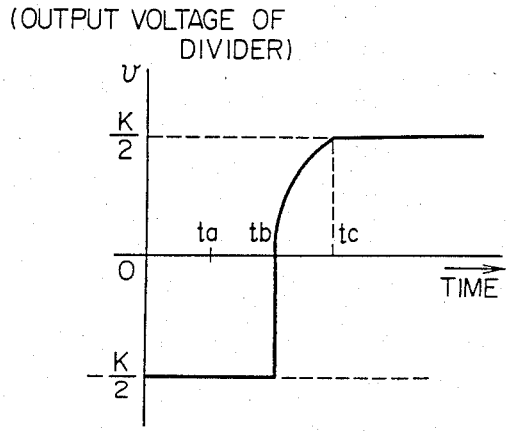
Figure 5B:
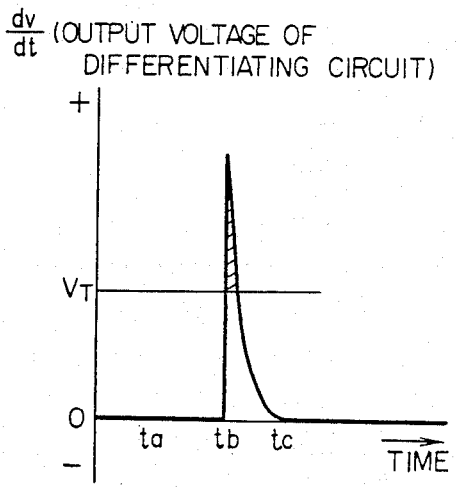

Thus, the relationship between the lapse of time and the output voltage v of the divider 17 includes the phenomenon in which the output voltage v of the divider 17 changes sharply at time $t_b$ at which a sharp change in the level of the reflecting point occurs, as shown in FIG. 5 (A).

As shown in FIG. 3, the output voltage v of the divider 17 is inputted to the differentiating circuit 18. The output signal (dv/dt) of the differentiating circuit 18 with the lapse of time ($t_a$--- $t_b$--- $t_c$) is as shown in FIG. 5 (B). As is apparent from the figure, the level of the reflecting point of the laser beam 2 changes sharply at time $t_b$, that is, when the laser beam 2 impinges on a shouldered portion produced by a fold of the printed copy 3. The sharp change in the level of the laser beam reflecting point can be detected as the output signal (dv/dt) of the differentiating circuit 18 in the form of a steep pulse wave.

The output signal (dv/dt) of the differentiating circuit 18 is inputted to the negative terminal of the comparator 19, with a threshold voltage $V_r$ that can be adjusted by means of VR2 being inputted to the positive terminal thereof. When the output signal (dv/dt) of the differentiating circuit 18 becomes a pulse wave and exceeds the threshold voltage $V_r$ (as indicated by a shaded area in FIG. (B)), the output signal of the comparator 19 is outputted as a count signal to the outside of the counter controller 10 shown in FIG. 1.

In the following, description will be made as to how the counting of the number of printed copies is made possible by this invention, referring to FIG. 6.

Figure 6A:
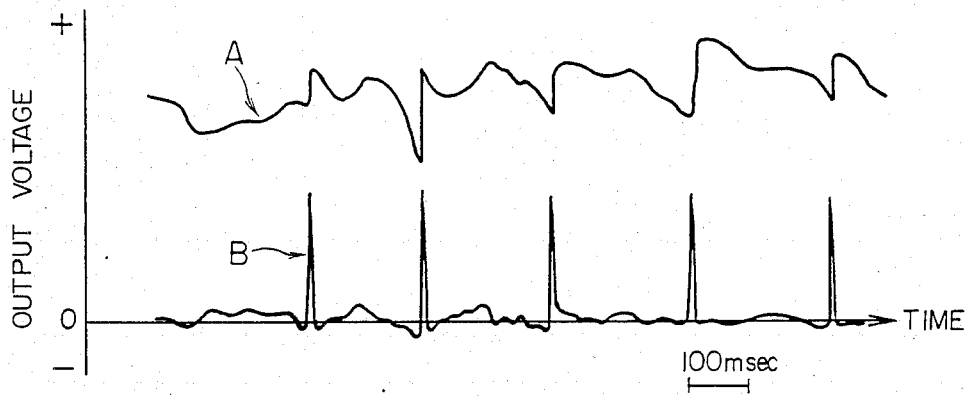
FIG. 6 is a diagram illustrating the signal waveforms in the essential parts of the electrical circuit used in the embodiment of this invention when printed matter is actually counted, and the detailed positional relationship of the light projector and receptor.
Figure 6B:
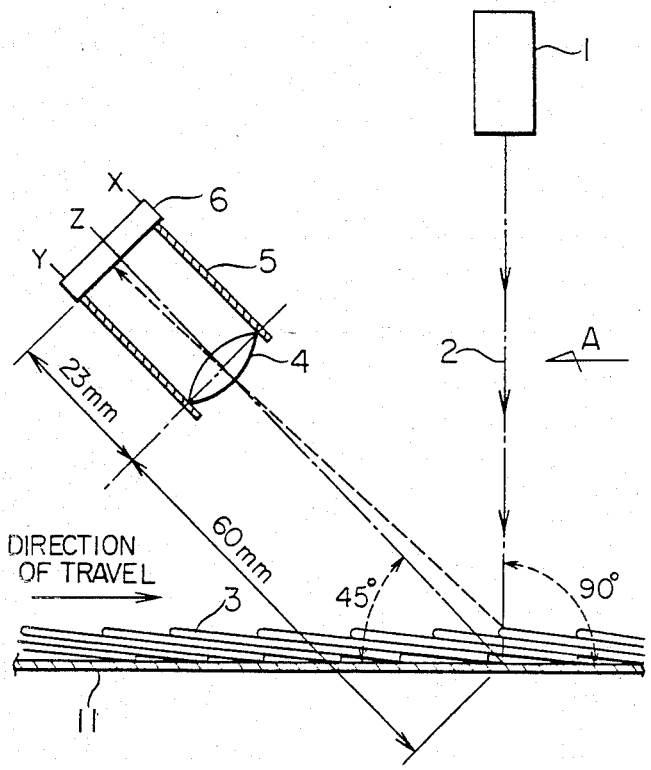
Figure 6C:
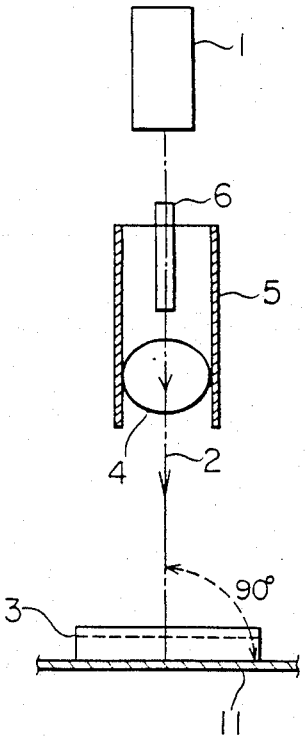

FIG. 6 (A) shows the waveforms of signals appearing on the essential parts of the electrical circuit when actually counting the number of 4-page newspaper copies in the positional relationship of the light projector and receptor in the embodiment of the invention shown in FIGS. 6 (B) and (C) (FIG. 6 (C) is a diagram viewed in the direction of arrow A in FIG. 6 (B).) A in FIG. 6 (A) is the waveform of the output voltage v of the divider 17 shown in FIG. 3, and B is the voltage waveform of the output signal (dv/dt) of the differentiating circuit 18. The waveform B assumes a steep pulse wave with the peaks thereof corresponding to the shouldered portions caused by the folds of newspaper, or sharp changes in the waveform A, indicating that this invention makes it possible to count the number of the printed copies 3.

As described above, the operating principle of this invention is based on the fact that the differentiated value, with respect to time, of the level of the light beam reflecting point on the surface of printed matter being transported becomes extremely larger at the shouldered portions caused by the folds of the printed matter, compared with the corresponding values at other portions on the printed matter. It is possible, therefore, to count the number of copies not only of thick printed matter but also of thin printed matter by substantially reducing the optical axis of the light beam to less than 1, mmϕ, for example, within the range of the light beam reflecting point level corresponding to the length of the light receiving surface of a light receiving element (the H range shown in FIG. 1).

The principal objects of this invention can no doubt be accomplished when a He-Ne laser or a semiconductor laser using a Ga-Al-As laser diode etc., or a white light source using a tungsten lamp, etc. is employed as the source of a light beam in this invention, or even when a two-dimensional position sensor is used in place of the aforementioned one-dimensional position sensor and one-dimensional or two-dimensional CCD elements are used in conjunction with such a position sensor, (though electrical circuits may be more complicated in these cases than those shown in FIG. 3.)

Figure 7A:
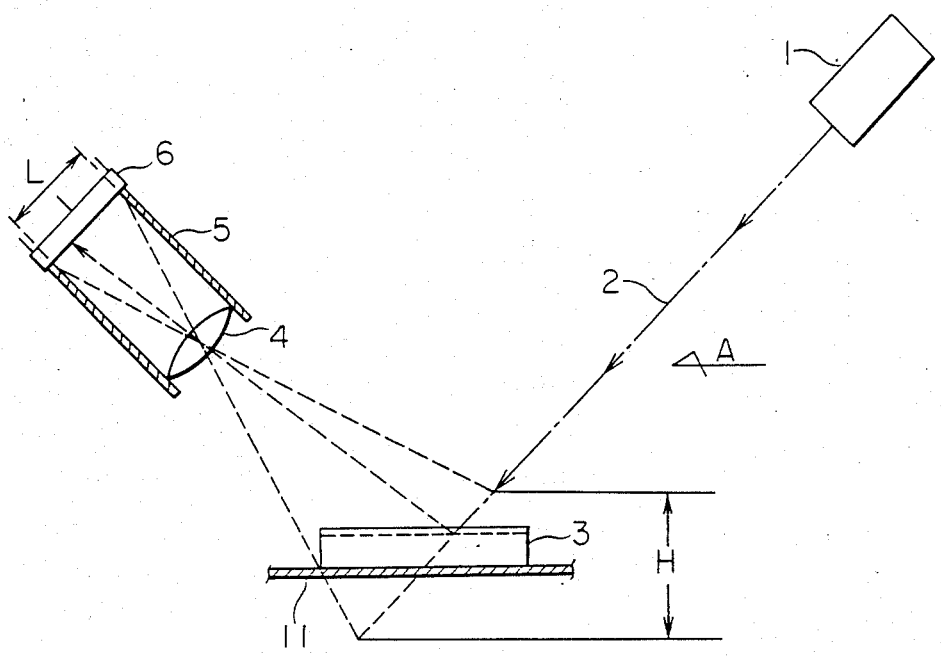
FIG. 7 is a diagram illustrating another embodiment of this invention in which the relative positions of the light projector and receptor, and printed matter are different from those in the embodiment shown in FIG. 1.
Figure 7B:
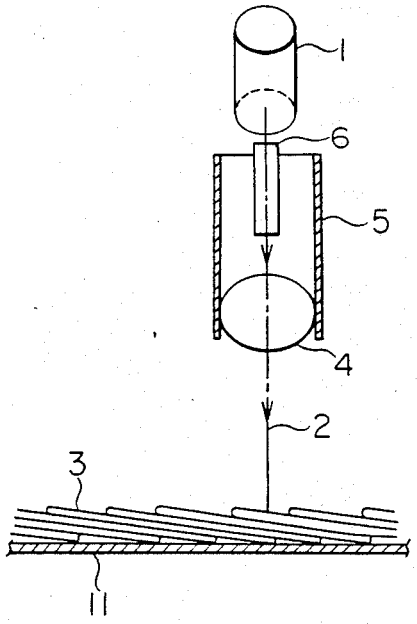

Besides the positional relationship of the light projector and receptor shown in FIG. 6 (B), another positional relationship, as shown in FIG. 7 (A) and FIG. 7 (B), which is a diagram viewed in the direction of arrow A in FIG. 7 (A), may be employed. The principal objects of this invention can also be accomplished in any positional relationship of the light projector and receptor so long as the lens and the light receiving element are disposed at locations within the reach of the reflected light beam. H shown in FIG. 7 is the range of the level of the laser beam reflecting point corresponding to the length L of the light receiving surface of the one-dimensional position sensor 6.

This invention can be applied to applications where constant-speed transport equipment consisting of a spring belt and other devices, in place of the aforementioned belt conveyor, is used as the transport equipment of printed matter. With this invention, the number of copies of printed matter can be counted even when the copies of printed matter are transferred on the conveyor line with the cut portions advanced as leading edges.

Although this invention has been described in the foregoing for embodiments as applied to the counting of the folded copies of printed matter, it is apparent that this invention is effective for other objects than the folded copies of printed matter, including corrugated boards, particle boards and other wooden sheeting, metal sheeting, felt sheeting, and any other objects of a plate or sheet shape having a certain thickness.

As described above, this invention makes it possible to count the number of objects being transported, whether thin or thick, by means of a single counter regardless of the surface condition of the objects, and without making contact with the objects since a light beam is projected onto the objects, and the sharp changes in the level of the reflecting point of the light beam caused by the shouldered portions, or the thickness of the objects are detected and converted into object count signals.

We claim:

1. A counter for counting the number of objects being transported by transport equipment, comprising: light projecting means for projecting a light beam onto a location in the path of said objects being transported; light receiving means including means for focusing said light beam reflected from said objects and means for receiving said focused light beam reflected from said objects, a focused point of light shifting in position on said means for receiving said focused light as the objects being transported are moved with respect to said light beam; position sensor means associated with said light receiving means for sensing a shift of the position of the focused point of said reflected light beam and for outputting an analog signal representing the position of the focused point of said reflected light on said means for receiving said focused light beam; a pulse generating means for generating pulses in response to sudden rapid changes in said analog signal representing the rapid shift of the focused point of said reflected light beam caused by movement of the ends of said objects; and, a counter for counting said pulses, the number of objects being counted on the basis of said pulses generated by said pulse generating means, said position sensor generates two analog signals representing a location at which the reflected light is focused on said reflected light receiving surface, said pulse generating means has an adder and a subtractor for receiving said two analog signals and adding and subtracting said two signals, respectively, a divider for dividing the added signals outputted by said adder with subtracting signals outputted by said subtractor, a differentiator for differentiating the output signal of said divider, and a comparator for comparing the differentiated output of said differentiator with a predetermined threshold value, changes in height of the objects being transported being indicated in the form of pulse signals generated when the output of said differentiator exceeds the predetermined threshold value.

2. A counter according to claim 1, wherein : sharp changes in the height of said objects are detected by converting changes in said reflected light focused point into electrical signals that correspond only to the location of said focused point.

3. An optical counting system for counting objects being transported by transport equipment, comprising: means for projecting a light beam onto a location in the path of objects being transported; light receiving means including means for producing a focused light beam from light reflected from said light beam projecting onto a location in the path of said objects being transported and surface means for receiving said focused light beam reflected from said objects, a focused point of light shifting in position on said surface means as the objects being transported are moved with respect to said projected light beams; means associated with said surface means for producing two analog signals representing a location at which the light is focused on said surface means; an adder and a subtractor for receiving said two analog signals and adding and subtracting said two signals respectively, a divider for dividing the added signals output by said adder with subtracting signals output by said subtractor; differential means for receiving the output of said representative of the position of said focused light beam on said surface means and for outputting a signal representative of the rate of change of said analog signal; comparator means for receiving said output of said differentiating means and for comparing said differentiating means output with a threshold value when the output signal of the differentiating means exceeds the threshold value, said comparator outputting a pulse signal representing a count of an object being transported.

* * * * *